US005931318A

United States Patent [19]

Shauo

[11] Patent Number: 5,931,318

[45] Date of Patent: Aug. 3, 1999

[54] TOOL BIT HOLDER

[76] Inventor: Shu-Shing Shauo, 8/F-1, No. 22, Lane 769 Chien-Hsin Rd., Taichung City, Taiwan

[21] Appl. No.: 09/095,561

[22] Filed: Jun. 11, 1998

[51] Int. Cl.[6] ..... A47F 7/00

[52] U.S. Cl. ..... 211/70.6; 206/378; 312/902

[58] Field of Search ..... 211/70.6, 69, 195; 206/377, 378, 379, 369, 372; 312/902

[56] References Cited

U.S. PATENT DOCUMENTS

| | | | |
|---|---|---|---|
| 1,671,159 | 5/1928 | Miller et al. . | |
| 4,880,122 | 11/1989 | Martindell | 211/70.6 |
| 5,108,287 | 4/1992 | Yee et al. | 206/379 X |
| 5,195,636 | 3/1993 | Wridt | 206/378 |
| 5,312,250 | 5/1994 | Ellman et al. | 206/379 X |
| 5,335,882 | 8/1994 | Liu | 206/377 |
| 5,732,820 | 3/1998 | Tsai | 206/369 |

*Primary Examiner*—Robert W. Gibson, Jr.
*Attorney, Agent, or Firm*—Rosenberg, Klein & Bilker

[57] ABSTRACT

A tool bit holder includes a rectangular hollow base, and a swivel holder mounted within the hollow base and turned in and out of the hollow base about an axis, wherein the swivel holder has a finger strip at an outer side thereof for turning with the hand, the finger strip having two opposite ends respectively protruded from the outer side wall of the swivel holder in reversed directions, one end of the finger strip being stopped at an edge at the hollow base when the swivel holder is turned out of the hollow base.

2 Claims, 4 Drawing Sheets

TOOL BIT HOLDER

BACKGROUND OF THE INVENTION

The present invention relates to a tool bit holder which comprised of a hollow base, and a swivel holder pivoted to the hollow base and turned in an out of the hollow base about an axis, the swivel holder having a finger strip for turning by hand.

FIGS. 1 and 2 show a tool bit holder according to the prior art. This structure of tool bit holder is comprised of a substantially rectangular hollow base 11, a swivel holder 12 pivoted to the hollow base 11 and turned in and out of the hollow base 11 about an axis 16, and a covering 14 covered on the hollow base 11 and fixedly secured thereto by rivets 13. The swivel holder 12 holds a set of tool bits 15. When the swivel holder 12 is turned about the axis 16 out of the hollow base 11, the user can then arrangement the tool bits 15. After arrangement, the swivel holder 12 is turned back and received inside the hollow base 11. This structure of tool bit holder is still not satisfactory in function. Because the swivel holder 12 has no handle means, it is inconvenient to turn the swivel holder 12 out of the hollow base 11 with the hand. When the swivel holder 12 is turned out of the hollow base 11, it cannot be firmly retained in position convenient for the user to arrange the tool bits 15.

SUMMARY OF THE INVENTION

The present invention provides a tool bit holder which eliminates the aforesaid drawbacks. According to one aspect of the present invention, a finger strip is fixedly fastened to an outer wall of the swivel holder through which the swivel holder can be conveniently turned in and out of the hollow base with the fingers. According to another aspect of the present invention, raised portions and recessed portions are respectively provided at the swivel holder and the hollow base, and the raised portions are respectively forced into engagement with the recessed portions when the swivel holder is turned out of the hollow base, causing the swivel holder to be firmly retained in position outside the hollow base.

DETAILED DESCRIPTION OF THE PREFERRED EMBODIMENT

Figure 1:
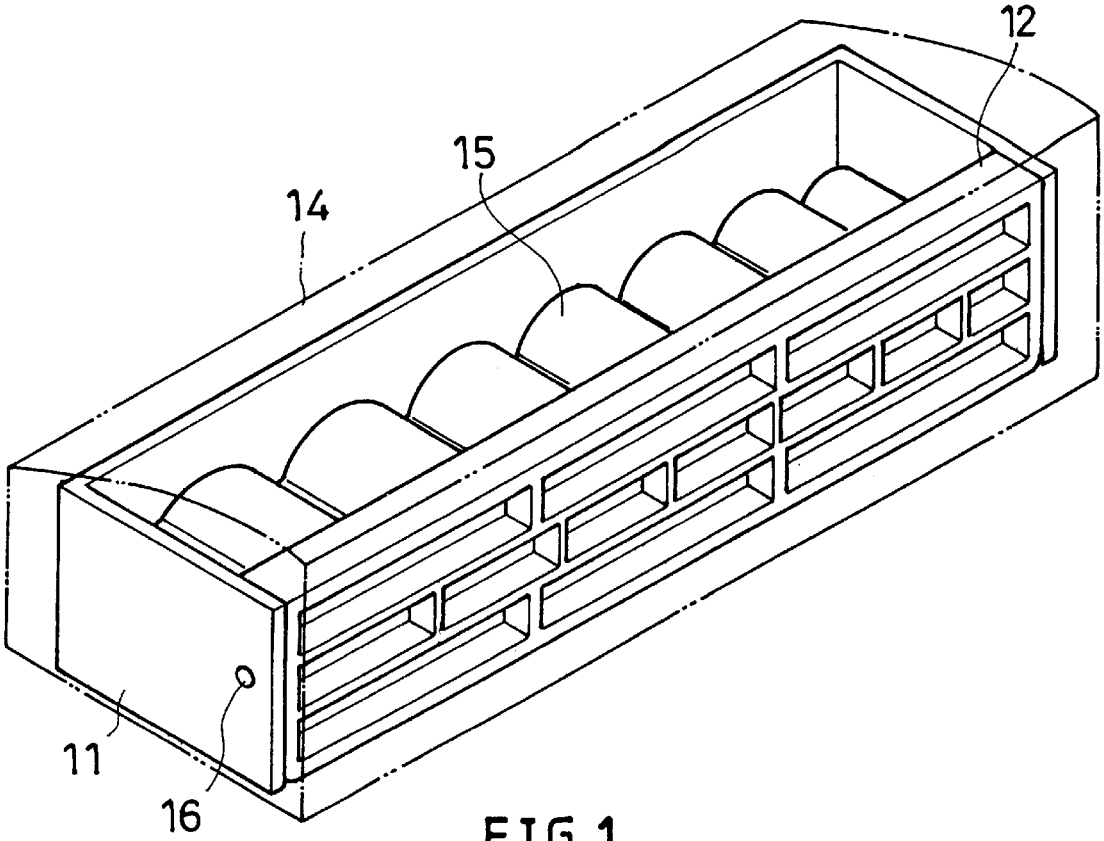
FIG.1 PRIOR ART
FIG. 1 is a perspective view of a tool bit holder according to the prior art.
Figure 2:
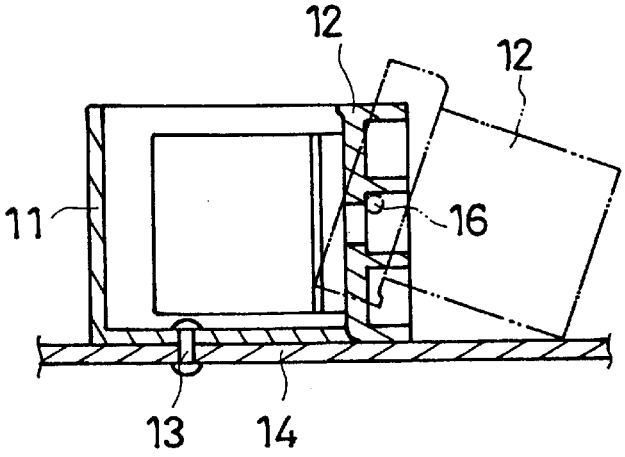
FIG.2 PRIOR ART
FIG. 2 is a sectional view of the prior art, showing the swivel holder turned between two positions.
Figure 3:
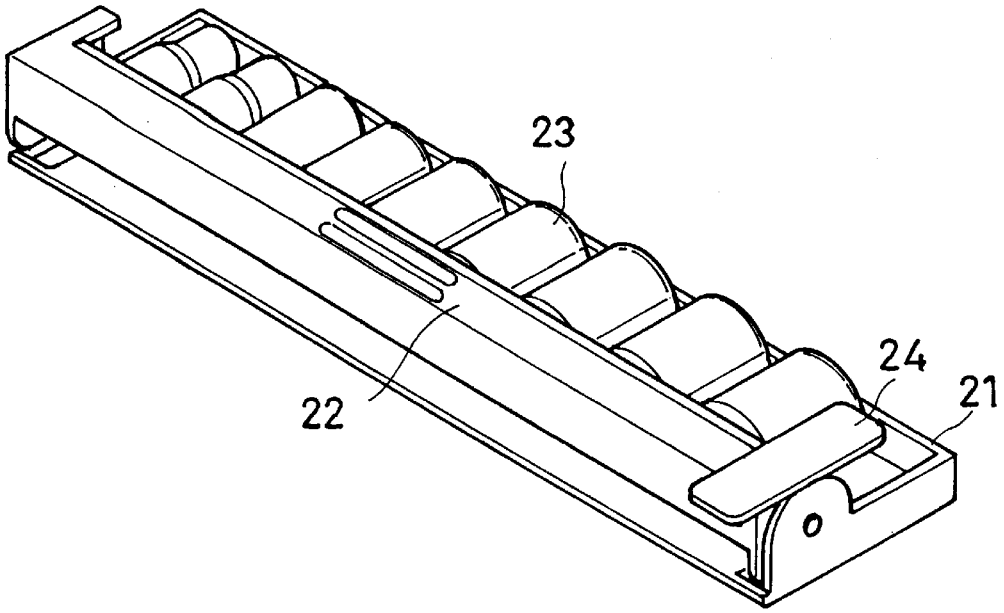
FIG. 3 is a perspective view of a tool bit holder according to the present invention.

Referring to FIG. 3, a tool bit holder is shown comprised of a rectangular hollow base 21, and a swivel holder 22 mounted within the base 21 and turned about an axis. The swivel holder 22 fits the hollow base, and holds a set of tool accessories (for example sockets for wrench 23. A finger strip 24 is fixedly fastened to the swivel holder 22 at one side near one end. The two opposite ends of the finger strip 24 protrude from top and bottom side walls of the swivel holder 22.

Figure 6:
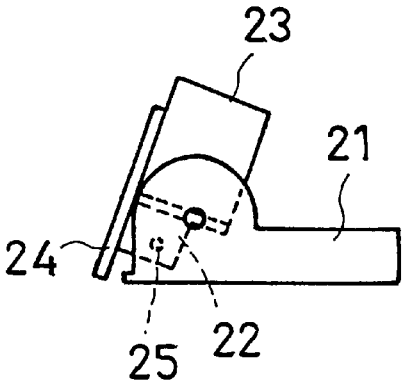
FIG. 6 is a side plain view of the present invention, showing the swivel holder turned out of the hollow base.
Figure 7:
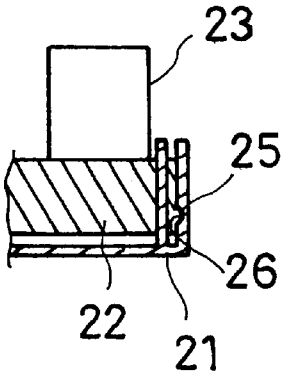
FIG. 7 is a sectional view of the present invention, showing the raised portion engaged with the recessed portion.

Referring to FIGS. 6 and 7, the base 21 has two recessed portions 26 at two opposite vertical end walls thereof on the inside, and the swivel holder 22 has two raised portions 25 respectively formed at opposite vertical end walls thereof on the outside for engagement with the recessed portions 26 at the base 21 (the two opposite vertical end walls of the swivel holder 22 are respectively pivoted to the vertical end walls of the base 21).

Figure 4:
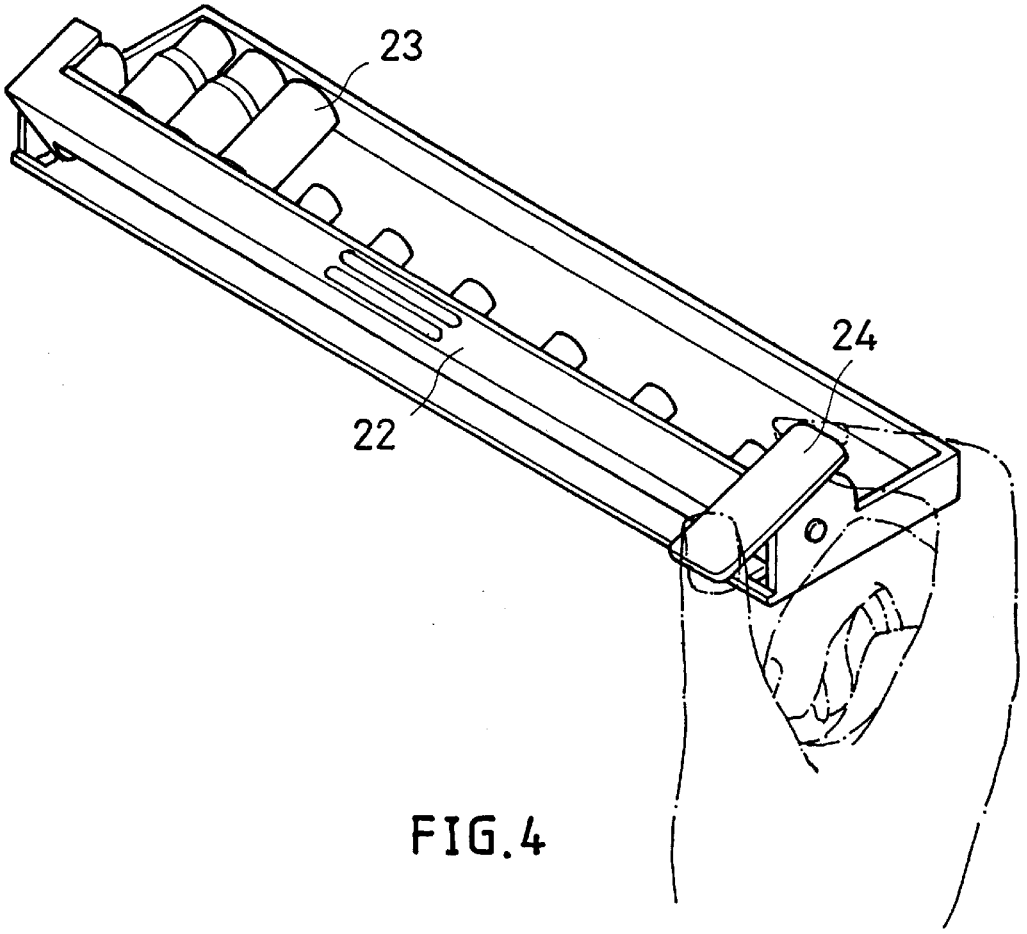
FIG. 4 is an applied view of the present invention.
Figure 5:
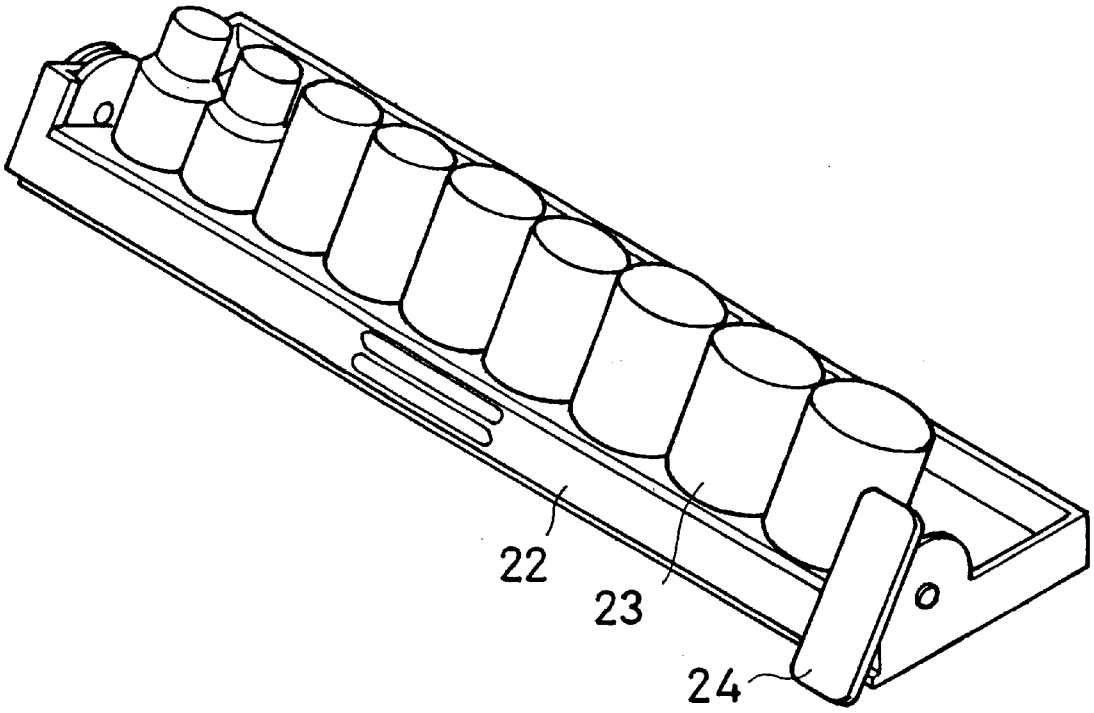
FIG. 5 is another perspective view of the present invention, showing the swivel holder turned out of the hollow base.

Referring to FIGS. 4 and 5, when in use, the user's fingers are attached to the two opposite ends of the finger strips 24, and then the swivel holder 22 is turned with the hand between a first position (see FIG. 3) and a second position (see FIG. 5).

Referring to FIGS. from 4 to 7 again, when the swivel holder 22 is turned out of the base 21 to the second position, one end of the finger strip 24 is stopped at an edge at the base 21, and the raised portions 25 of the swivel holder 22 are forced into engagement with the recessed portions 26 at the base 21, and therefore the swivel holder 22 is held firmly in the second position, enabling the user to conveniently arrange the tool accessories 23. When the swivel holder 22 is turned to the first position by force, the tool accessories 23 are moved with the swivel holder 22 to the inside of the base 21.

Figure 8:
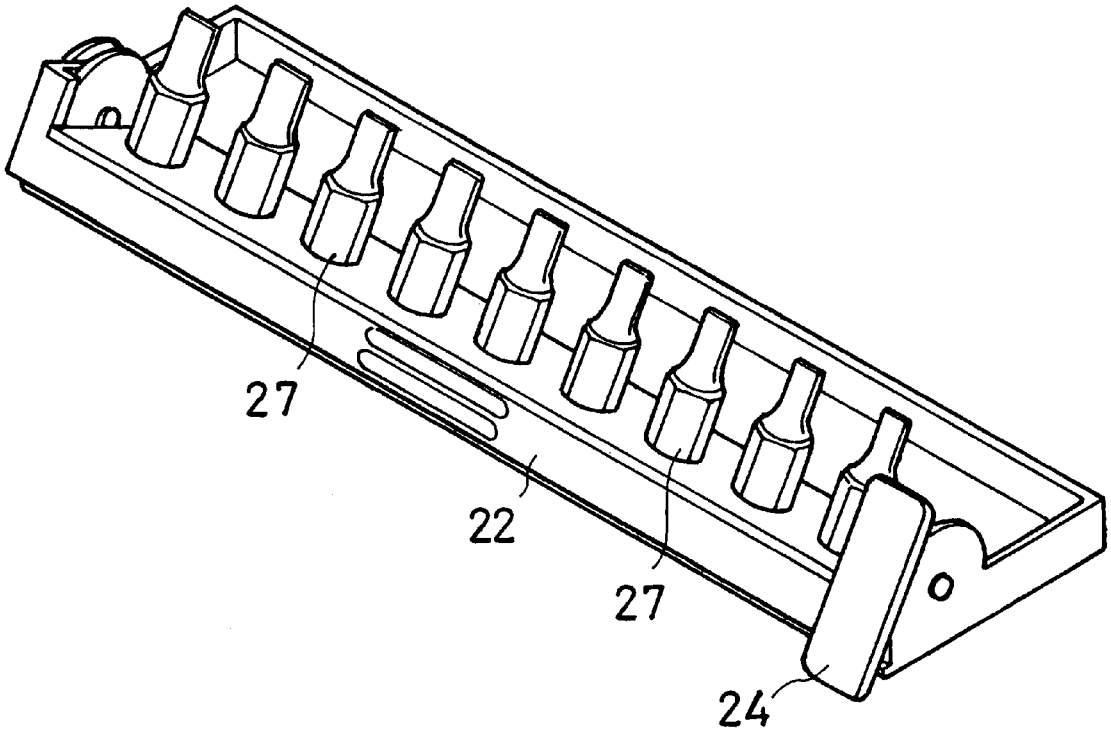
FIG. 8 is a perspective view of an alternate form of the present invention.

FIG. 8 shows an alternate form of the present invention in which the swivel holder 22 has a plurality of holes for holding bits for screwdriver 27.

It is to be understood that the drawings are designed for purposes of illustration only, and are not intended as a definition of the limits and scope of the invention disclosed.

What the invention claimed is:

1. A tool bit holder comprising a rectangular hollow base, and a swivel holder mounted within said hollow base and turned in and out of said hollow base about an axis, wherein a finger strip is fixedly fastened to an outer side wall of said swivel holder near one end for turning with the fingers, said finger strip having two opposite ends respectively protruded from the outer side wall of said swivel holder in reversed directions, one end of said finger strip being stopped at an edge at said hollow base when said swivel holder is turned out of said hollow base.

2. The tool bit holder of claim 1 wherein said hollow base has a plurality of recessed portions bilaterally disposed on the inside, and said swivel holder has a plurality of raised portions bilaterally disposed on the outside, the raised portions of said swivel holder being respectively forced into engagement with the recessed portions at said hollow base to hold said swivel holder in position when said swivel holder is turned out of said hollow base.

* * * * *